US010357790B1

(12) United States Patent
Hennemann et al.

(10) Patent No.: US 10,357,790 B1
(45) Date of Patent: Jul. 23, 2019

(54) DEVICE FOR WITHDRAWING AND DISPENSING A VISCOUS PRODUCT, WITHOUT TAKING IN AIR

(71) Applicant: Promens SA, Bellignat (FR)

(72) Inventors: Pascal Hennemann, Vaux les Saint Claude (FR); Gwénael Doulin, Sainte Euphemie (FR)

(73) Assignee: PROMENS SA, Bellignat (FR)

( * ) Notice: Subject to any disclaimer, the term of this patent is extended or adjusted under 35 U.S.C. 154(b) by 0 days.

(21) Appl. No.: 16/157,670

(22) Filed: Oct. 11, 2018

(51) Int. Cl.
*B05B 11/00* (2006.01)
*B05B 15/30* (2018.01)

(52) U.S. Cl.
CPC ..... *B05B 11/30* (2013.01); *B05B 15/30* (2018.02)

(58) Field of Classification Search
CPC ..... B85B 11/30; B85B 11/00; B05B 15/30; B65D 83/32
USPC ..... 222/105, 106, 209, 211, 464.1, 464.7
See application file for complete search history.

(56) References Cited

U.S. PATENT DOCUMENTS 4,286,636 A * 9/1981 Credle ..... B65D 83/0055 141/114
4,953,753 A * 9/1990 Gortz ..... B65D 83/0061 222/105
5,746,350 A * 5/1998 Nishigami ..... B05B 11/3023 222/95
9,932,167 B2 * 4/2018 Ogata ..... B65D 83/62
2006/0113319 A1 * 6/2006 Smith ..... B65D 77/065 222/105
2006/0180616 A1 * 8/2006 Woods ..... B65D 83/32 222/402.1
2010/0276448 A1 * 11/2010 Moretti ..... B05B 11/00412 222/105
2015/0014990 A1 * 1/2015 Bodet ..... B65D 83/32 285/406
2015/0344214 A1 * 12/2015 Yamaguchi ..... B65D 83/38 222/95
2016/0144388 A1 * 5/2016 Hennemann ..... B05B 11/0037 222/173

* cited by examiner

*Primary Examiner* — Lien M Ngo
(74) *Attorney, Agent, or Firm* — Brinks Gilson & Lione; John C. Freeman

(57) ABSTRACT

A device for withdrawing and dispensing a viscous product includes a pumping member and a dip tube that includes an upper end connected to a corresponding portion of the pumping member. The dip tube includes a lower portion having a free lower end, with a circumference of the lower portion opened by at least one longitudinal slot formed parallel to a longitudinal axis of the dip tube, wherein the longitudinal slot forms a gutter with a bottom, the lower portion includes pins arranged inside the gutter and extending transversally to the longitudinal slot and away from the bottom of the gutter, the pins being dispatched along the longitudinal slot.

12 Claims, 6 Drawing Sheets

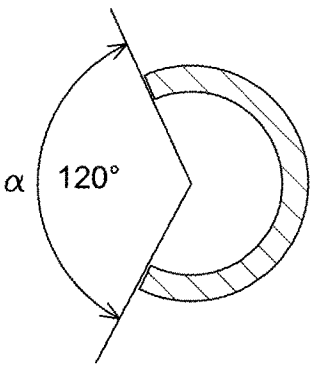
Fig. 9
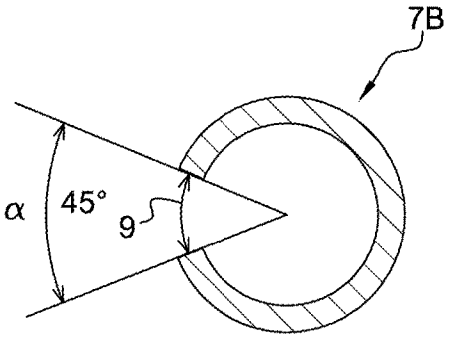
Fig. 8
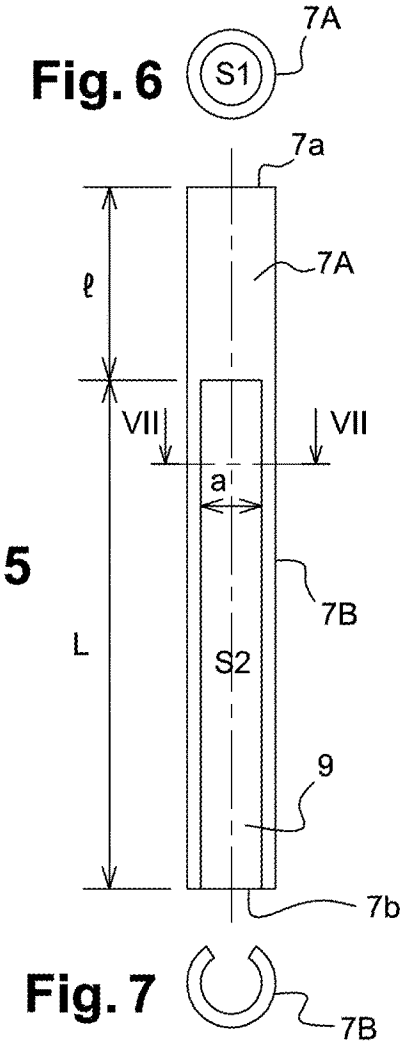
Fig. 6
Fig. 5
Fig. 7

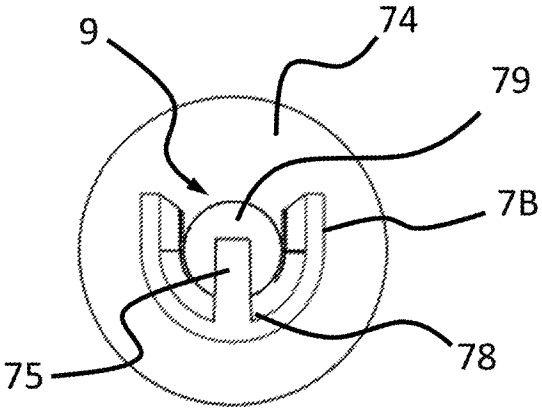
Fig. 20
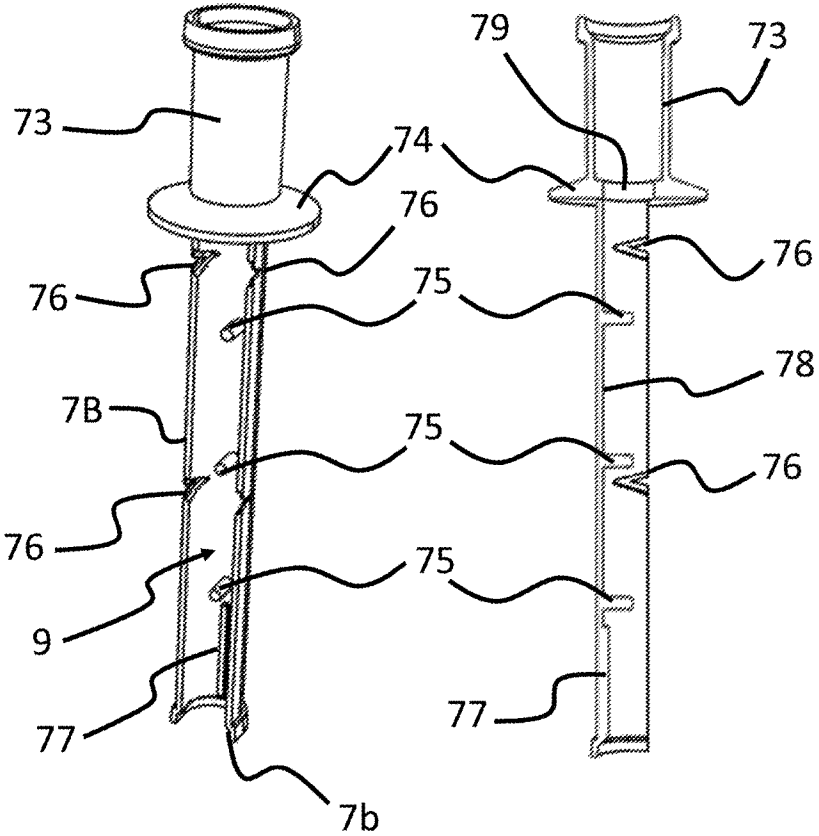
Fig. 19
Fig. 18

DEVICE FOR WITHDRAWING AND DISPENSING A VISCOUS PRODUCT, WITHOUT TAKING IN AIR

BACKGROUND

The present invention relates to a device for withdrawing and dispensing a viscous product, without taking in air.

It finds application in pharmaceutical or cosmetic products, but also food products, for particularly greasy and pasty products such as mayonnaise for example.

SUMMARY

The high viscosity of all these products has the disadvantage of causing a reduction in the release rate of the bottle when emptying the bottle. It is known that these products can be drained of their content using a pump of the airless type associated with the bottle, without taking in air. It is necessary to use either airless bottles with pistons or airless bottles using a pouch. In fact, these systems make it possible to release viscous products more effectively. In certain cases, for products with high viscosity packaged in tall bottles, the pouch systems can lose their release performance and can require a dip tube, which has the effect of considerably slowing the operation of the pump. Indeed, when the pouch is full of product, a traditional dip tube absorbs the product by its lower end, but the pressure drop is then high.

The solution would be to increase the diameter of the dip tube. The problem would remain the same because the volume of product and air to be carried, having increased, would also increase the number of priming strokes.

It is also necessary to take into account the fact that, in the presence of a viscous product, during assembly of the pumping member associated with the dip tube, the air caught inside it creates a blockage, which is more difficult to overcome during first actuations if the viscosity of the product is higher.

One could consider solving this problem by having a shorter tube, therefore having a smaller air blockage, thus reducing pressure losses because there is less air to be removed.

But in this case, when finishing using the product, a short tube would not be able to absorb the residual product in the bottom of the pouch. Indeed, by gravity, the product has a tendency to remain in the bottom of the pouch, while the walls thereof collapse at mid-height, preventing the product from rising up to the pump.

According to a first phase of the inventive approach, it was sought to combine the advantage of the short tube to prime the product rapidly and the long tube to collect the product over the entire height of the pouch.

To this end, the invention disclosed in U.S. Patent Application Publication No. 2016/0144388, published on May 26, 2016, the entire contents of which is incorporated herein by reference, relates to a device for withdrawing and dispensing a viscous product, without taking in air, including, on the one hand, a pumping member positioned, by its base, at the open end of a rigid container associated with a flexible internal retractable pouch, designed to receive the product, and, on the other hand, a dip tube connected by its upper end to a corresponding portion of the pumping member and of which the free lower end is submerged in the product.

The dip tube disclosed in U.S. Patent Application Publication No. 2016/0144388, includes:

a first upper portion, with a closed circumference, defining a reference section of the tube, obtained as a single part with a corresponding portion of the pumping member, and with a predetermined length, a second lower portion extending the first upper portion and being engaged by interlocking with it, having its circumference opened by at least one longitudinal slot formed along a generator and defining a C- or U-shaped section over this portion of the tube, so that the product can penetrate into it simultaneously at every point of the length of its slotted portion, having the effect of a collector, with a greater surface area than the flow area with a closed circumference of its upper portion.

Though this enables a good strength of suction of the product, sometimes because of the above mentioned slot section design on the entire length of the lower portion, the flexible internal retractable pouch might enter the longitudinal slot before the pouch is empty. In such a case, the remaining product is blocked by the pouch itself and cannot be dispensed any more.

To solve this problem, in the device according to the present invention the longitudinal slot forms a gutter with a bottom, the lower portion including pins arranged inside the gutter and extending transversally to the longitudinal slot and away from the bottom of the gutter, the pins being dispatched along the longitudinal slot.

The pins protruding from the bottom of the gutter prevent the pouch to enter inside or too much inside the longitudinal slot, such that the pouch will not close this slot.

SUMMARY OF THE INVENTION

A first aspect of the present invention regards a device for withdrawing and dispensing a viscous product without taking in air, the device including a pumping member having a base positioned at an open end of a rigid container associated with a retractable flexible internal pouch designed to receive the viscous product. The device including a dip tube including an upper end connected to a corresponding portion of the pumping member, so that the upper end is partially submerged in the viscous product and the free lower end of the dip tube is totally submerged in the viscous product. The dip tube includes an upper portion having the upper end, wherein the upper portion defines a closed circumference being formed as a single part with the pumping member and the upper portion has a predetermined length. The dip tube further includes a lower portion having the free lower end, wherein the lower portion extends the upper portion by being engaged to the upper portion by interlocking, with a circumference of the lower portion opened by at least one longitudinal slot formed parallel to a longitudinal axis of the dip tube and defining a uniform C-shaped or U-shaped section over an entire length of the lower portion of the tube, so that the viscous product can enter into the lower portion of the dip tube simultaneously at every point of the length of the longitudinal slot. The longitudinal slot has a surface area greater than a flow section with a closed circumference of the upper portion, wherein the longitudinal slot forms a gutter with a bottom, the lower portion including pins arranged inside the gutter and extending transversally to the longitudinal slot and away from the bottom of the gutter, the pins being dispatched along the longitudinal slot.

One or more aspects of the present invention provide the advantage of preventing a flexible internal retractable pouch from entering the longitudinal slot before the pouch is empty.

The present invention also relates to the characteristics that will be revealed during the description that follows, and which should be considered in isolation or according to all their technically possible combinations.

This description, given by way of a non-limiting example, will make it easier to understand how the invention can be implemented with reference to the appended drawings wherein:

BRIEF DESCRIPTION OF THE DRAWINGS

FIGS. 5, 6 and 7 show the tube in the first embodiment of the invention, respectively in a plan view, from above and from below.

FIGS. 8 and 9 show respectively, in a transverse section along line VII-VII of FIG. 7 and at a larger scale, the section of the dip tube in its slotted portion, according to two different embodiments.

FIG. 18 is a perspective view of the dip tube of FIG. 17.

FIG. 19 is a longitudinal section view of the dip tube of FIG. 18.

FIG. 20 is a transversal section view of the tube of FIG. 18.

DETAILED DESCRIPTION

Figure 1:
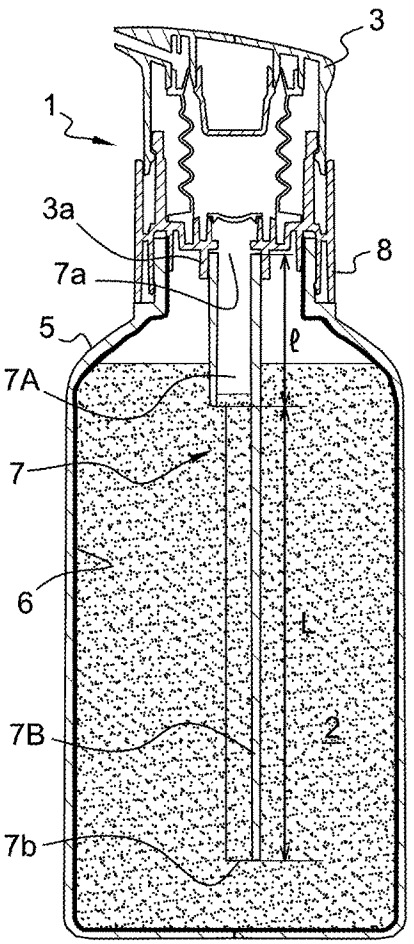
FIG. 1 shows, in section, a withdrawing device according to a first embodiment of the invention, when the product is first used.

The withdrawal and dispensing device 1, globally designated in the figures, includes on the one hand a pumping device (3) positioned, by its base (8) at the open end (4) of a rigid container (5) associated with an internal retractable flexible pouch (6) designed to receive the product (2), and on the other hand to a dip tube (7) connected by its upper end (7*a*) to a corresponding portion (3*a*) of the pumping member, so that the upper end (7*a*) is partially submerged in the product (2) and the free lower end (7*b*) is totally submerged in the product (2).

According to the invention, the dip tube (7) includes:

a first upper portion (7A) with a closed circumference, defining a reference section (S1) of the tube (7), engaged hermetically over a corresponding portion (3*a*) of the pumping member (3) and with a predetermined length (1), a second lower portion (7B), extending the first (7A), having an circumference opened by at least one longitudinal slot (9) formed along a generator and defining a C- or U-shaped section over this portion of the tube (7), so that the product (2) can penetrate into it simultaneously at every point along the length (L) of its slotted portion (9) having the effect of a collector, with a surface area (S2) greater than the flow area (S1) with a closed circumference of its upper portion (7A).

This allows rapid priming, due to the first short portion with a closed circumference, and a good release rate due to the second portion with an open slotted circumference.

The opening angle of the longitudinal slot (9) of the second lower open portion (7B) of the tube (7) represents a circular sector of which the apex angle ($\alpha$) is comprised between 45 and 120°.

Initially, it is 90°.

The width "a" of the slot is optimized so that it allows the product to enter easily into the tube through the slot, without however allowing the introduction of the pouch by aspiration at the end of the release.

Tests have demonstrated that, with a tube having a closed circumference, 88% release is obtained, while with the tube partially open according to the invention, 97% release is obtained, with the same highly viscous product.

Figure 2:
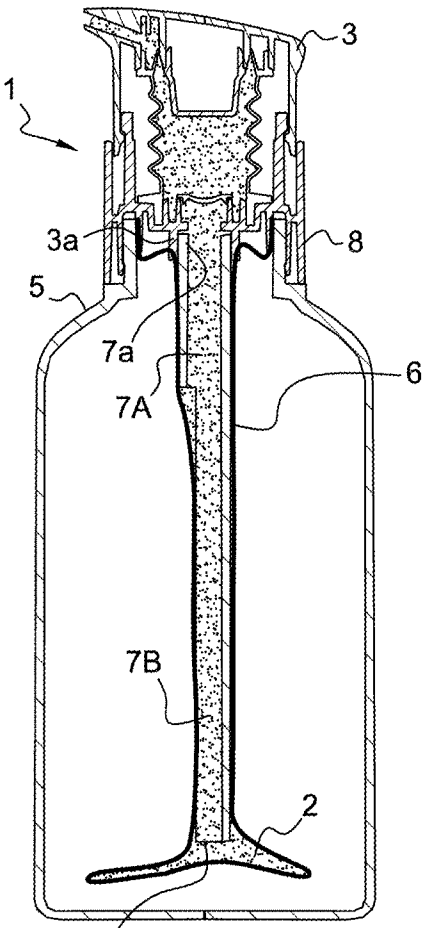
FIG. 2 shows the same device according to FIG. 1, when finishing using the product.
Figure 3:
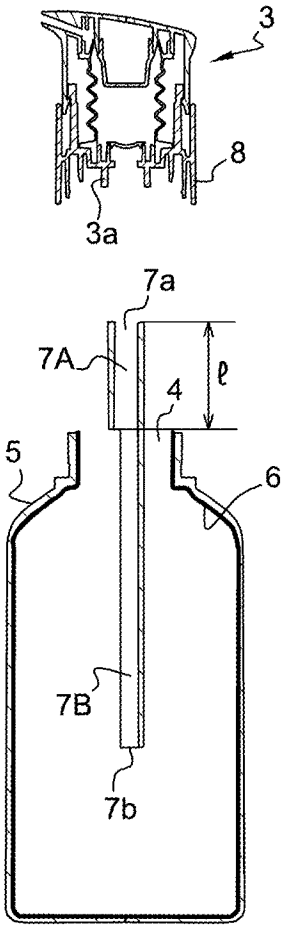
FIG. 3 shows, at a smaller scale, an exploded view of the portions constituting the device according to FIGS. 1 and 2, in a first embodiment of the dip tube.

According to a first embodiment (FIGS. 1 to 3), the first and second portions (7A, 7B) of the dip tube (7) are obtained by plastic molding, to form a one-piece element. An example of the first embodiment is disclosed in U.S. Patent Application Publication No. 2016/0144388, published on May 26, 2016, the entire contents of which is incorporated herein by reference.

Figure 4:
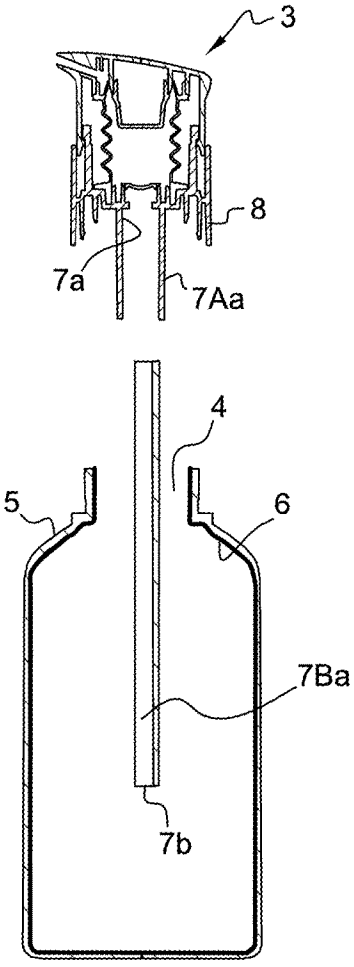
FIG. 4 shows an exploded view similar to FIG. 3 of the portions constituting the device in a second embodiment of the dip tube.
Figure 11:
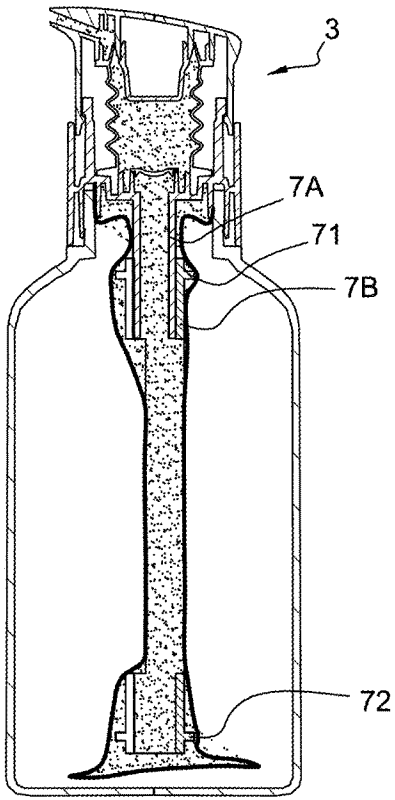
FIGS. 10 to 12 are similar views to respectively FIGS. 1 to 3, according to a third embodiment of the invention.
Figure 10:
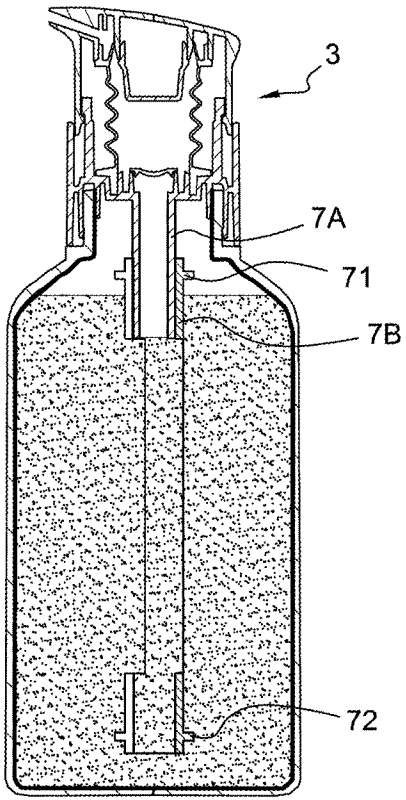
Figure 12:
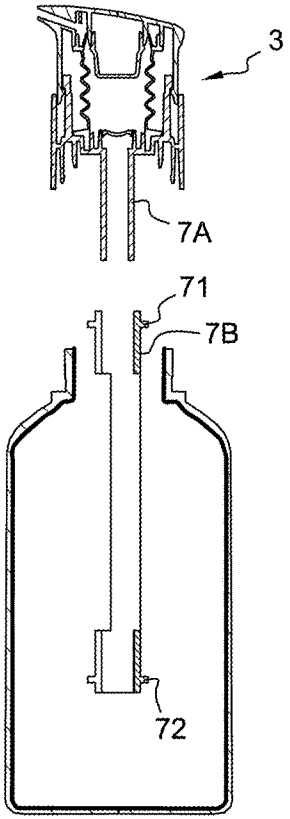

According to a second embodiment (FIG. 4), the first and second portions (7A, 7B) of the dip tube (7) are obtained separately from one another, one of them higher, with a closed circumference (7A), being obtained by plastic molding with the base (3*a*) of the pumping member (3), and with which the lower portion with an open circumference (7B) cooperates by interlocking with it. In this embodiment, the second portion (7B) is inserted inside the first portion (7A).

According to a third embodiment, shown in FIGS. 10 to 16, the second portion (7B), split over its entire length, is pressed on outside the first portion (7A). The second portion (7B) further includes a first open reinforcing ring (71) which extends circumferentially and with the same sector angle as the second portion (7B) in a region that covers the first portion (7A). The first reinforcing ring (71) is used to increase the stiffness of the second portion (7B) so as to obtain reinforced clamping over the first portion (7A).

The second portion (7B) includes a second reinforcing ring (72), symmetric with respect to a transverse plane. The presence of the second reinforcing ring (72) is not functional, but rather makes it possible to avoid orienting the second portion during assembly with the pump (3). Each end of the second portion (7B) is identical and can be pressed on over the first portion (7A).

Figure 15:
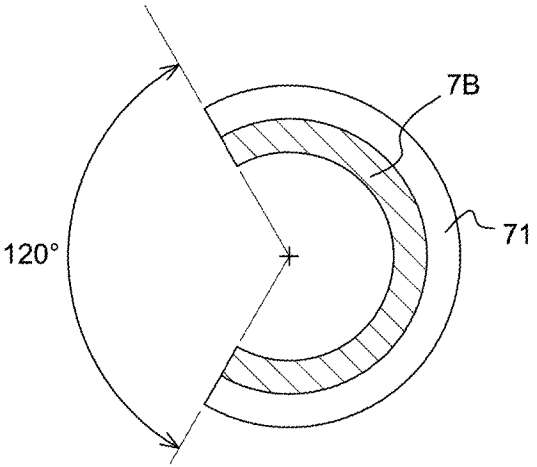
FIGS. 15 and 16 are views similar to FIG. 14 according to variants.
Figure 14:
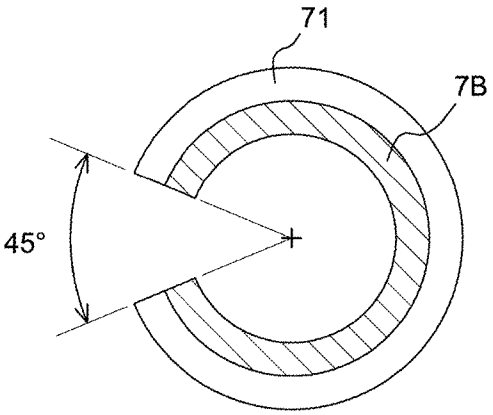
FIG. 14 is a transverse section view along the line XIV-XIV of FIG. 13.
Figure 16:
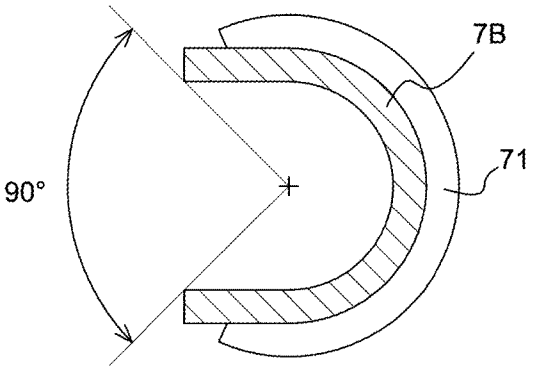
Figure 13:
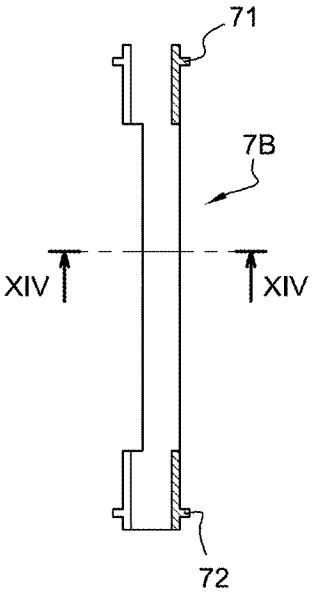
FIG. 13 is a longitudinal section view of the tube of FIG. 12.

As shown in FIGS. 14 to 16, the sector angle of the second portion (7B) can be selected, as in the first embodiment, for example between 45 and 120°, 90° for example.

In variants that are not shown, the second portion (7B) includes several reinforcing rings at each end.

Also further subjects of the invention can be:

further subject a): a device (1) for withdrawing and dispensing a viscous product (2) without taking in air, including on the one hand a pumping member (3) positioned, by its base (8), at the open end (4) of a rigid container (5) associated with a retractable flexible internal pouch (6) designed to receive the product (2), and on the other hand a dip tube (7) connected at its upper end (7*a*) to a corresponding portion (3*a*) of the pumping member, so that the upper end (7*a*) is partially submerged in the product (2) and the free lower end (7*b*) is totally submerged in the product (2), characterized in that the dip tube (7) includes:

a first upper portion (7A) with a closed circumference, defining a reference section (S1) of the tube (7), obtained as a single part with the pumping member (3), and with a predetermined length (1), a second lower portion (7B) extending the first (7A) by being engaged to it by interlocking, with a circumference opened by at least one longitudinal slot (9), formed along a generator and defining a C- or U-shaped section over this portion of the tube (7), so that the product (2) can enter into it simultaneously at every point of the length (L) of its slotted portion (9), acting as a collector, with a surface area (S2) greater than the flow section (S1) with a closed circumference of its upper portion (7A).

further subject b): the device according to further subject a), characterized in that the opening angle of the longitudinal slot (9) of the second lower open portion (7B) of the tube (7) represents a circular sector of which the apex angle ($\alpha$) is between 45 and 120';

further subject c): the device according to one of further subject a) or b), wherein the second lower open portion (7B) of the tube (7) includes at least one reinforcing ring (71, 72) extending along a section surrounding the first portion (7A).

further subject d): the device according to further subject c), wherein the second lower open portion (7B) of the tube (7) is symmetrical with respect to a transverse plane.

further subject e): The device according to one of further subject a) or b), characterized in that the first portion (7A) of the dip tube (7) is obtained by plastic molding with a base (3*a*) of the pumping member (3).

FIGS. 17 to 20 illustrate a fourth embodiment. The differences between this fourth embodiment and the third embodiment are disclosed by the following paragraphs. Only these differences are specified in details below and one can refer to the preceding paragraphs in respect of the third embodiment for the other features of the fourth embodiment of FIGS. 17 to 20. The reference from the common features are the same.

In this fourth embodiment, the longitudinal slot (9) forms a gutter with a bottom (78), the lower portion (7B) of the dip tube (7) includes pins (75) arranged inside the gutter.

As can be seen in these figures, the pins (75) are each extending transversally to the longitudinal slot (9) and away from the bottom of the gutter formed by the longitudinal slot (9). More particularly, in the illustrated example, the pins extend radially.

Here the dip tube (7) includes three pins (75) dispatched vertically, i.e. along the longitudinal slot (9).

The pins (75) have a length that is equal or more than the half of the depth of the gutter formed by the longitudinal slot. Here they are about two thirds.

FIG. 20 shows the middle pin (75) in front of the opening (79) through which the viscous products (2) will be sucked out from the container (5) into the dosing chamber (10). It can be seen that the pins (75) will keep the pouch at a certain distance from the bottom (78), enabling a path for the viscous product (2).

The lower portion (7B) of the dip tube (7) can also, but not necessarily, comprise a rib (77) arranged inside the gutter.

As illustrated, this rib can start close to the free lower end (7*b*) and extend in length upward longitudinally in respect of the dip tube (7*b*). The height of the rib is extending radially.

This rib (77) also keep the pouch at a certain distance from the bottom (78), enabling a path for the viscous product (2).

The longitudinal slot (9) has an upper limit, said longitudinal slot extending downward from this upper limit.

The dip tube (7) includes a skirt (74) extending outside the dip tube and perpendicularly to the longitudinal tube axis, the skirt being arranged at the upper limit of the longitudinal slot (9).

Figure 17:
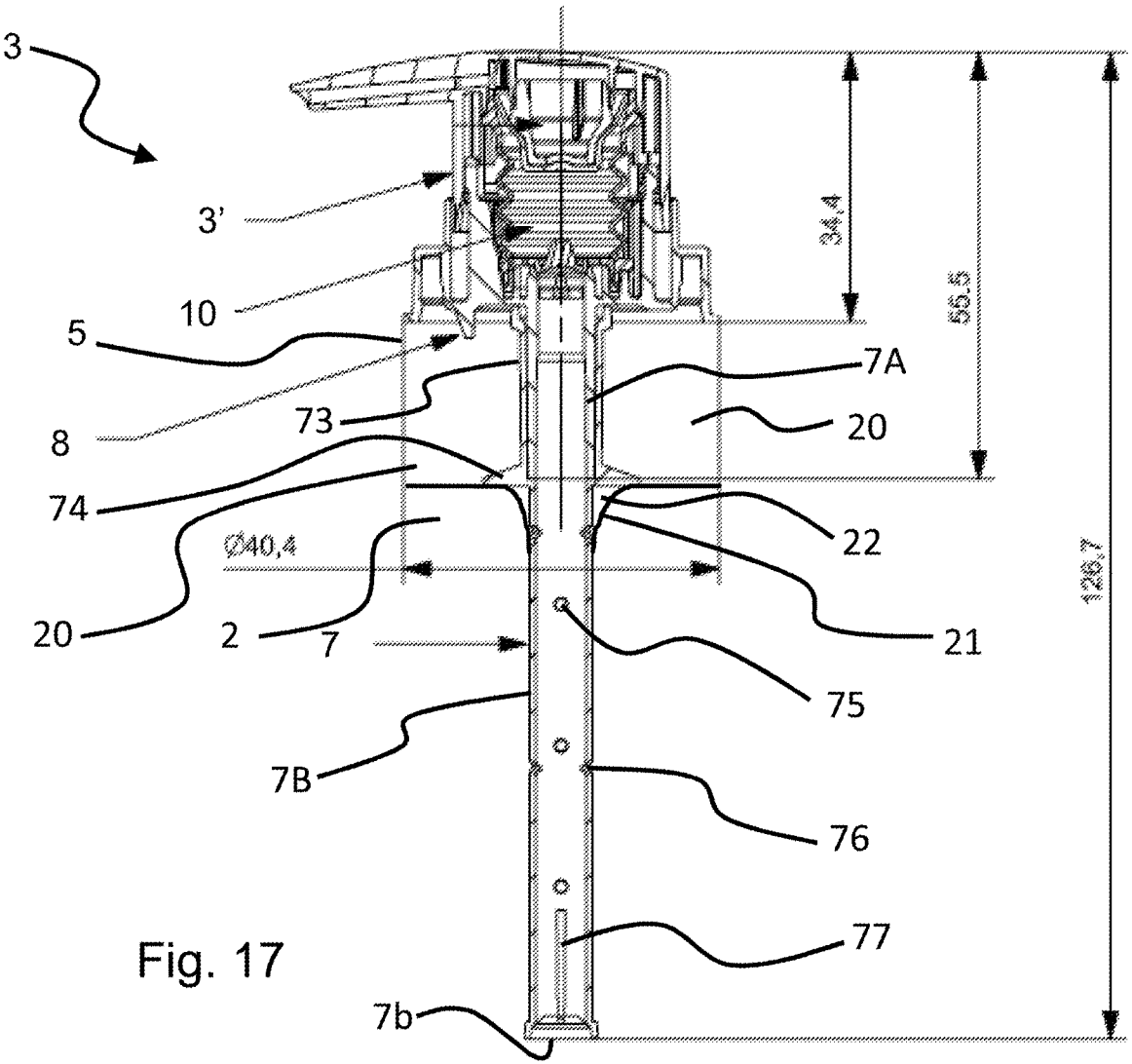
FIG. 17 shows, in section, a withdrawing device according to fourth embodiment of the invention.

As can be seen on FIG. 17, this horizontal skirt (74) is just above the slot (9), approximatively in the upper quarter of the dip tube (7), so that it enables seal with the viscous product (2).

Some products are so viscous that when one enters an object inside and withdraws it, it leaves a print inside the product that will stay for quite a long time.

As can be seen in FIG. 17, the insertion of the dip tube (7) has printed an insertion well (22) inside the product (2). This insertion well (22) is full of air and creates a film of air around the dip tube, at least on the upper part of the longitudinal slot (9).

Without the skirt (74) of the illustrated example, the risk would be that the air (20) contained between the surface (21) of the viscous product (2) and the base (8), would reach the longitudinal slot (9). This could generate an unpriming of the manual pump, and stop the product (2) entering the dosing chamber (10) of the device (3).

However, this skirt (74) seals the insertion well (22). The air (20) contained between the surface (21) and the base (8) cannot reach the longitudinal slot (9).

Here, the skirt (74) has a diameter which is about three time the depth of the gutter formed by the longitudinal slot (9), improving therefore the seal of the insertion well (22).

The lower portion comprises an interlocking part (73), the lower portion (7B) being engaged to the upper portion (7A) by the interlocking part, the interlocking part extending upward from the skirt (74).

According to the invention, or as in this example, the interlocking part (73), the skirt (74) and the lower portion (7B) can be made as a single piece, for example by molding.

This single piece can be made of polypropylene.

One other risk with viscous products is that the pouch (6) might strongly push on the lower portion (7B). This generates a risk of disengaging the interlocking part (73) from the base (8).

To lower this risk, as in this example, the lower portion (7B) can include pairs of notches (76) formed on two longitudinal edges of the gutter formed by the longitudinal slot (9).

As can be seen in FIGS. 17 to 19, here two pairs of notches are arranged along the edges of the longitudinal slot (9).

For each pair of notches (76), a first notch is on one edge and a second notch is on the other edge, the firs notch and the second notch of a same pair being at the same height in respect of the longitudinal axis of the dip tube (7). In other words, in each pair, the notches (76) face each other.

These notches (76) enables further flexibility of the lower portion (7B) and form therefore articulations of the lower portion (7B), which will enable the lower portion to bend in case of a strong lateral push from the pouch (6), and therefore lower the risk of disengagement.

Here, the notches (76) are "V" shaped, which makes them easy to realize and creates an accurate articulation.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A device for withdrawing and dispensing a viscous product without taking in air, the device comprising:

a pumping member comprising a base positioned at an open end of a rigid container associated with a retractable flexible internal pouch designed to receive the viscous product;

a dip tube comprising an upper end connected to a corresponding portion of the pumping member, so that the upper end is partially submerged in the viscous product and a free lower end of the dip tube is totally submerged in the viscous product, wherein the dip tube comprises:

an upper portion comprising the upper end, wherein the upper portion defines a closed circumference being formed as a single part with the pumping member and the upper portion has a predetermined length; and a lower portion comprising the free lower end, wherein the lower portion extends the upper portion by being engaged to the upper portion by interlocking with a circumference of the lower portion opened by at least one longitudinal slot formed parallel to a longitudinal axis of the dip tube and defining a uniform C-shaped or U-shaped section over an entire length of the lower portion of the tube, so that the viscous product can enter into the lower portion of the dip tube simultaneously at every point of a length of the longitudinal slot, wherein the longitudinal slot has a surface area greater than a flow section with a closed circumference of the upper portion, wherein the longitudinal slot forms a gutter with a bottom, the lower portion comprising pins arranged inside the gutter and extending transversally to the longitudinal slot and away from the bottom of the gutter, the pins being dispatched along the longitudinal slot.

2. The device according to claim 1, wherein the pins have a length that is equal or more than half of a depth of the gutter formed by the longitudinal slot.

3. The device according to claim 1, wherein the longitudinal slot has an upper limit, the longitudinal slot extending downward from the upper limit, and wherein the dip tube comprises a skirt extending perpendicularly to the longitudinal axis, the skirt being arranged at the upper limit of the longitudinal slot.

4. The device according to claim 3, wherein the skirt has a diameter that is about three times a depth of the gutter formed by the longitudinal slot.

5. The device according to claim 3, wherein the lower portion comprises an interlocking part, the lower portion being engaged to the upper portion by the interlocking part, the interlocking part extending upward from the skirt.

6. The device according to claim 1, wherein the lower portion comprises pairs of notches formed on two longitudinal edges of the gutter formed by the longitudinal slot, the pairs of notches being arranged such that for each pair of notches a first notch is on one of the two longitudinal edges and a second notch is on a second one of the two longitudinal edges, the first notch and the second notch of a same pair being at an identical height in respect of the longitudinal axis of the dip tube.

7. The device according to claim 6, wherein the first notch and the second notch are "V" shaped.

8. The device according to claim 1, wherein an opening angle of the longitudinal slot of the lower portion represents a circular sector of which an apex angle ($\alpha$) is between 45 and 120°.

9. The device according to claim 1, wherein the lower portion comprises at least one reinforcing ring extending along a section surrounding the upper portion.

10. The device according to claim 9, wherein the lower portion is symmetrical with respect to a transverse plane perpendicular to the longitudinal axis.

11. The device according to claim 1, wherein the upper portion is integral with the base of the pumping member.

12. The device according to claim 1, wherein the longitudinal slot defines the uniform C-shaped or U-shaped section over an entire length of a second lower portion to the free lower end.

* * * * *